US008668632B2

(12) United States Patent
Ellis

(10) Patent No.: US 8,668,632 B2
(45) Date of Patent: Mar. 11, 2014

(54) EXERCISE APPARATUS

(76) Inventor: Eric Ellis, Rosedale, NY (US)

( * ) Notice: Subject to any disclaimer, the term of this patent is extended or adjusted under 35 U.S.C. 154(b) by 257 days.

(21) Appl. No.: 13/233,129

(22) Filed: Sep. 15, 2011

(65) Prior Publication Data

US 2013/0072361 A1 Mar. 21, 2013

(51) Int. Cl.
*A63B 21/04* (2006.01)
*A63B 21/00* (2006.01)

(52) U.S. Cl.
USPC ..... 482/130; 482/133; 482/138

(58) Field of Classification Search
USPC ..... 482/51–52, 55, 57, 62, 70–73, 79–80, 482/92, 121–126, 128–130, 133–138, 142, 482/145; 248/430; 297/344.1
See application file for complete search history.

(56) References Cited

U.S. PATENT DOCUMENTS

| | | | | |
|---|---|---|---|---|
| 1,750,549 | A | 3/1930 | Thomson et al. | |
| 3,770,267 | A | 11/1973 | McCarthy | |
| 5,279,530 | A | 1/1994 | Hess | |
| 5,496,246 | A | 3/1996 | Pierre | |
| 5,759,137 | A | 6/1998 | Huang | |
| 5,807,211 | A | 9/1998 | Berryhill | |
| 5,860,898 | A * | 1/1999 | Ellis | 482/130 |
| 6,589,142 | B2 * | 7/2003 | McAfee, Jr. | 482/133 |
| 7,115,080 | B2 * | 10/2006 | Cockrill et al. | 482/138 |
| 7,128,700 | B2 | 10/2006 | Wallach | |
| 7,621,852 | B2 | 11/2009 | Bowser | |
| 7,708,670 | B2 | 5/2010 | Bowser | |
| 7,775,949 | B2 | 8/2010 | Bowser | |
| 2008/0242519 | A1 | 10/2008 | Parmater | |

* cited by examiner

*Primary Examiner* — Loan Thanh
*Assistant Examiner* — Jennifer M Deichl
(74) *Attorney, Agent, or Firm* — Mitchell A. Smolow

(57) ABSTRACT

A complex exercise machine utilizes a horizontally extending frame assembly having a plurality of resistance elements. A plurality of foot pedals are included that are slidably mounted on the frame assembly. The foot pedals are moveable between a first position, proximate to the user, and a second distal position. The resistance elements have a first end and a second end. The first end of the resistance element is removably anchored to the frame assembly A first resistance element includes a handle at its second to exercise upper body muscle groups, while a second resistance element includes the pedals at its second end to exercise lower body and abdominal muscle groups. A seat is provided that is adjustably mounted to the frame assembly. The angulation between the seat back and seat bottom is also adjustable.

20 Claims, 7 Drawing Sheets

EXERCISE APPARATUS

FIELD OF THE INVENTION

This invention relates generally to exercise equipment, and in particular, to a compact, simple and flexible full body exercise apparatus.

BACKGROUND OF THE INVENTION

Maintaining good health is achieved in large part by maintaining good physical fitness. Exercise machines, useful in achieving and maintaining good physical fitness, are of varied designs. One class of exercise machine is designed to work targeted muscle groups only, thereby requiring multiple machines to achieve a total body work-out. Examples of targeted machines are stationary bicycles, treadmills, and stepper machines. Often these devices are large and not easy to store.

A second class of exercise machine, known in the art as a complex exerciser, is configurable or adjustable to enable a user to engage in many varied and different exercises targeting multiple muscle groups, typically by allowing for a number of different body positions such as sitting, laying down, standing, etc. These complex exercisers are often mechanically complicated, having many parts, and may require the user to rearrange or add constituent assemblies to accommodate the various exercises supported. Often, these types of exercisers are expensive and typically do not store easily in a small area such as under a bed.

Accordingly, there is still a continuing need for improved complex exerciser designs. The present invention fulfills this need and further provides related advantages.

BRIEF SUMMARY OF THE INVENTION

The present invention comprises a complex exerciser having a simple design which enables a user to exercise multiple muscle groups. This simple design achieves significant manufacturing cost savings and is storable in a relatively small area, yet allows for quick easy adjustment to accommodate users of differing heights.

In a preferred embodiment a complex exerciser is disclosed, wherein muscle groups are exercised by providing resistance to repetitive movements of the user.

A horizontally extending frame assembly is provided having a plurality of resistance elements. A plurality of foot pedals are included that are slidably mounted on the frame assembly. The foot pedals are moveable between a first position, proximate to the user, and a second distal position. The resistance elements have a first end and a second end. The first end of the resistance element is removably anchored to the frame assembly A first resistance element includes a handle at its second to exercise upper body muscle groups, while a second resistance element includes the pedals at its second end to exercise lower body and abdominal muscle groups. A seat is provided that is adjustably mounted to the frame assembly. The angulation between the seat back and seat bottom is also adjustable.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
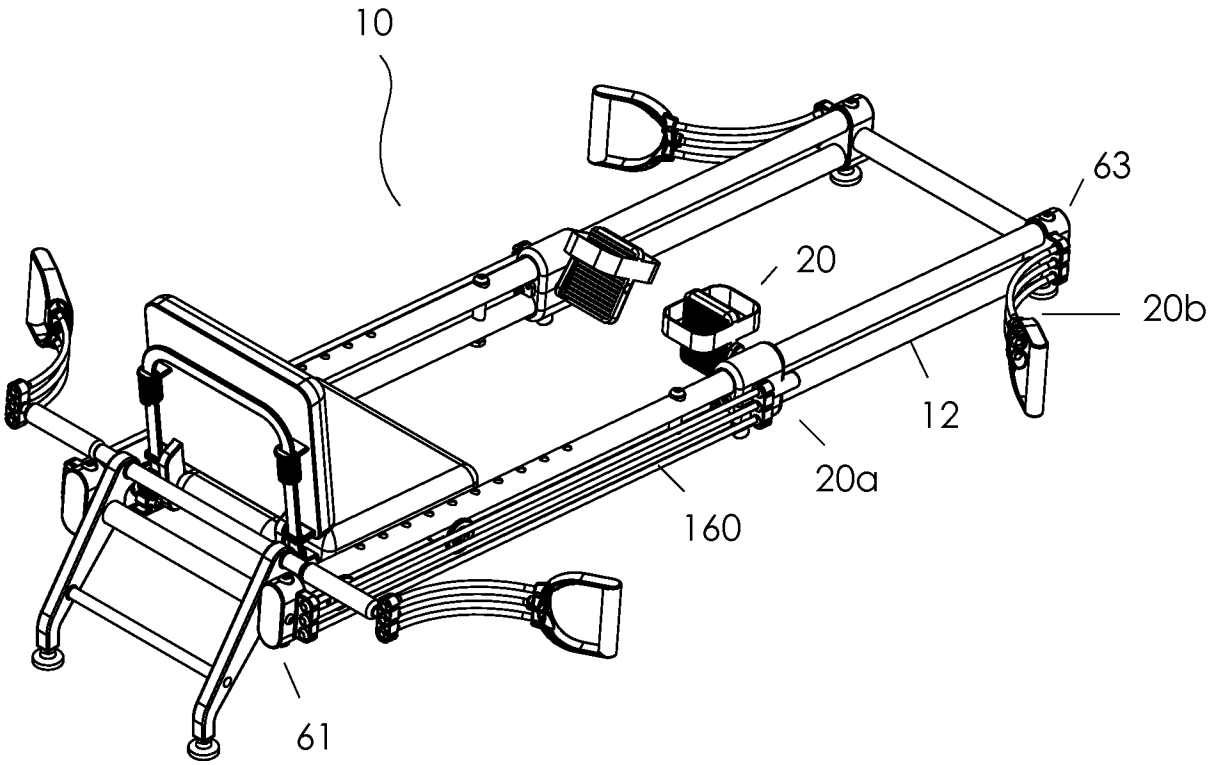
FIG. 1 is a perspective view of the exercise apparatus.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several views of the present invention described herein.

Referring now to FIGS. 1-4, there is provided a perspective view of the exercise apparatus 10 of the present invention. A substantially rectangular shaped frame assembly 12 comprises a first and second set of spaced, elongated parallel members 16, 16' and a pair of cross members 18, 18'. Additional cross members may be included to stiffen the frame assembly 12, as required. It must be understood that the frame assembly 12 may be provided by other structures as can be provided by skilled persons. For example, each cross member 18, 18' may be comprised of a plurality of elements or components (not explicitly shown for simplicity).

The spaced, elongated parallel members 16, 16' are fixed below and above front cross member 18 and rear cross member 18'. Cross members 18 and 18' provide spacing between the elongated parallel members 16, 16'. Spaced, elongated parallel members 16, 16' and front and rear cross members 18, 18' are further fixed in their relationship to one another by insertion into corner piece 60 and by tube spacer assembly 62, comprised of cap screw 64, washer 66, tube spacer 68, and nut 70. A corner piece 60 is fixed at each corner by attachment to each end of front and rear cross members 18, 18' by screw 182. Leveling foot 180 is mounted to the underside of the front of each elongated member 16.

Rear cross member 18' is received by rear leg assembly 170. Rear leg assembly 170 further comprises top cross piece 176, bottom cross piece 178, and two leveling feet 180. Push-up handle cord stop 172 is attached to push-up handle 174 using fastener 182 so that the cord stop 172 can swivel.

Push-up handle 174 is fixed to top cross piece 176. In this exemplar, top cross piece 176 is located above rear cross member 18'.

The spaced, elongated parallel members 16, 16' are provided to enable foot pedal assembly 20 to be slidably mounted between them. The foot pedal assembly 20 is slideable to move between a first position 20*a* and a second position 20*b*. The first position 20*a* may be termed proximal to the position/location of the user, while the second position 20*b* may be termed distal to the position/location of the user.

Figure 9:
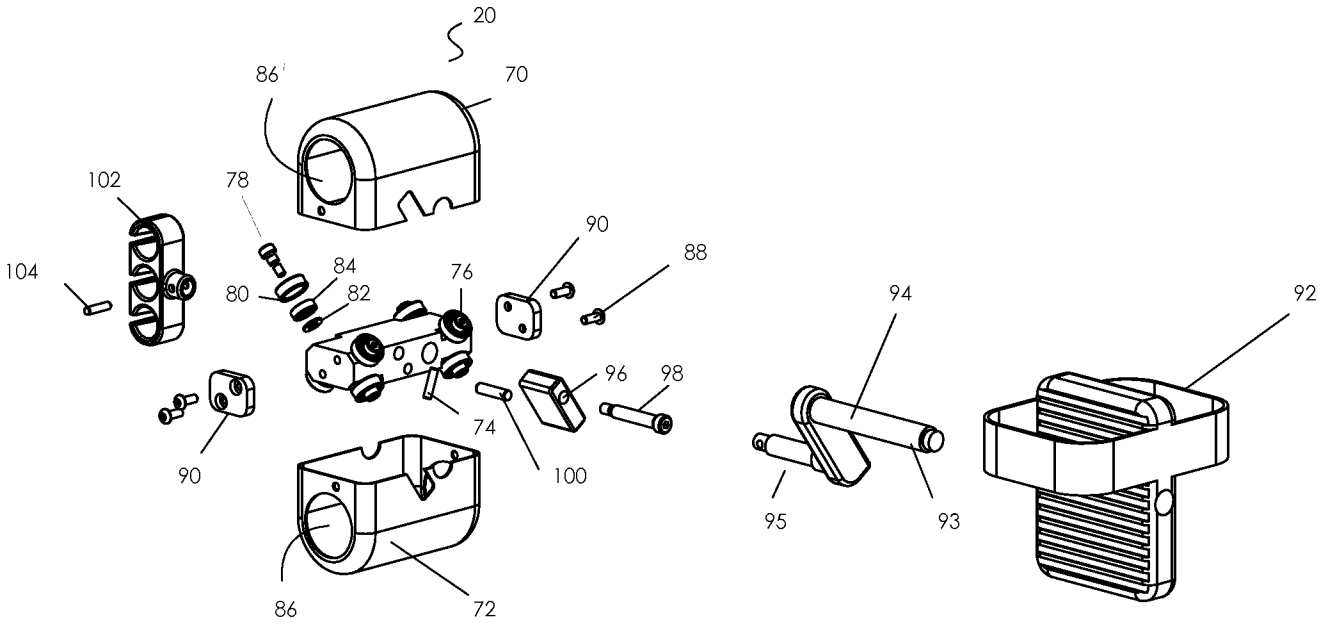
FIG. 9 is an exploded perspective view of the foot pedal assembly.

The foot pedal assembly 20 is represented in FIG. 9. Upper and lower foot slider covers 70, 72 house foot pedal carrier 74, comprised of a roller assembly 76 located to roll against elongated parallel members 16, 16' when assembled. Roller assembly 76 comprises head screw 78 received by carrier 74, roller 80, bearing 84, and washer 82. Lower and upper foot slider covers 72, 70 form lower and upper channels 86, 86' to slidably receive elongated parallel members 16, 16', thereby maintaining carrier 74 in slidable contact with elongated parallel members 16, 16'. Cap screw 88 fixes a slider bumper 90 to the front and rear of carrier 74.

Pedal 92 is mounted to a first arm 93 of crank 94. A second arm 95 of crank 94 passes through the carrier 74. Foot stop 96 is attached to carrier 74 by shoulder screw 98. Dowel pin 100 provides extra support for the foot stop 96. Pedal cord stop 102 is fixed by dowel 104 to the second arm 95 of crank 94 which extends past the carrier 74.

Turning now to FIGS. 5-8, a seat assembly 120 is provided for adjustable mounting on the frame assembly 10. This adjustment of the seat position forward and backward accommodate users of differing heights. In particular, if a user has long legs the seat may be moved back, thereby increasing the distance between the foot pedals 92 and the seat 124.

Seat assembly 120 comprises seat back 126 hingeably attached to seat bottom 128 by a rear wheel axle 134 which passes through a pair of ratchets 132 mounted to the seat bottom 128. The angle $\alpha$ formed by the seat back 126 to seat bottom 128 is maintained by a spring tensioned back adjustment bar 130 slidably fixed to the seat back 126 and received by the pair of ratchets 132. Springs 148 are tensioned by locating them between spring pin 150 (received by back adjustment bar 130) and upper bar mount 152. In this manner the seat back may be brought to a horizontal (flat) or even negative position relative to the seat bottom, thereby enhancing a user's ability to perform push-ups, leg, and stomach exercises.

Rear wheel axle 134 rotatively receives a wheel assembly 136 at each end. Wheel assembly 136 comprises a spacer 138, a seat wheel 140, two bearings 142, a washer 144, and a retaining ring 146, depicted in FIG. 6. A front wheel axle 150 passes through a pair of axle mounts 152 fixed to seat bottom 128 and rotably receives a wheel assembly 136 at each end.

Figure 2:
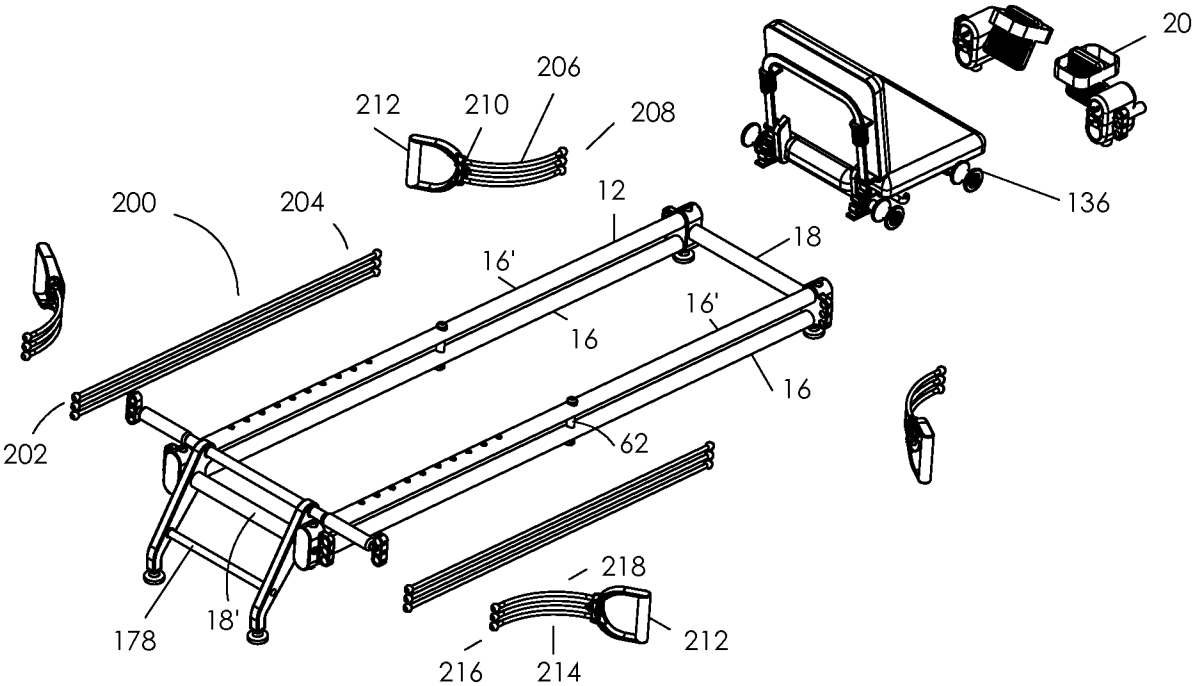
FIG. 2 is an exploded perspective view of the exercise apparatus.
Figure 3:
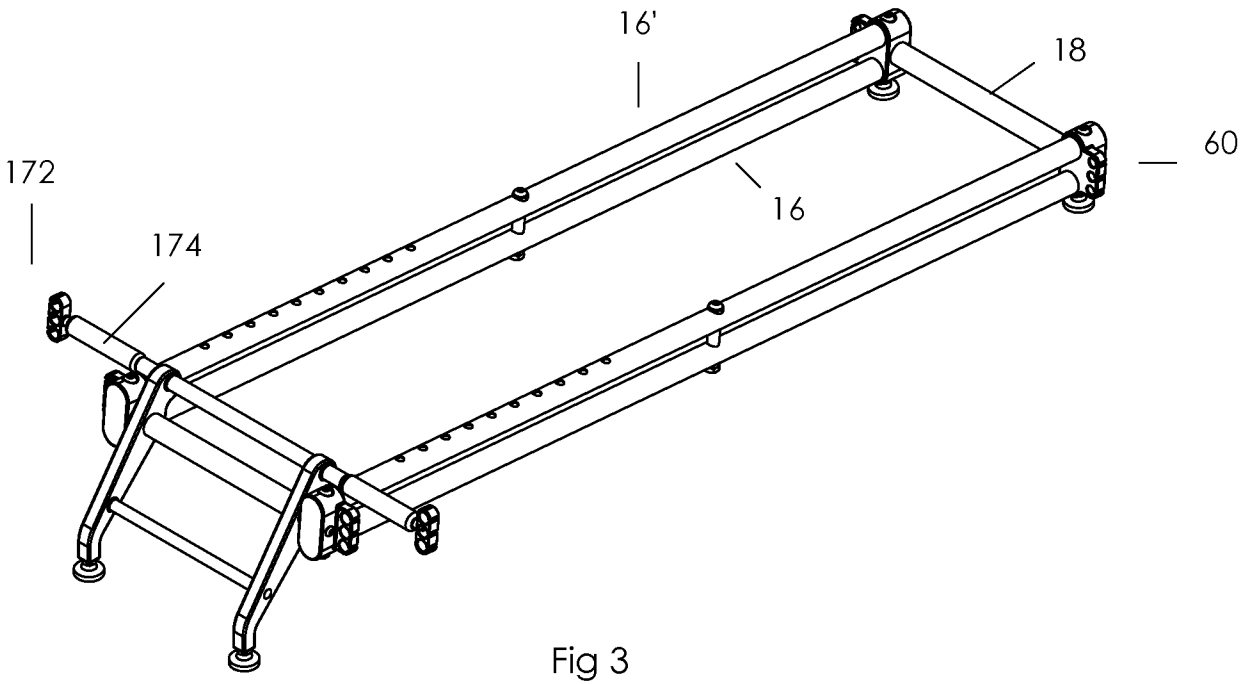
FIG. 3 is a perspective view of the frame assembly.

The geometry of wheel 140 is such that it is rotably maintained between elongated parallel members 16, 16' (FIGS. 1 and 2). In the exemplar, the geometry of wheel 140 comprises an inner and outer flange 141, 141' (FIG. 5) which prevents lateral displacement of wheel as it travels along the elongated parallel members 16, 16'.

Figure 4:
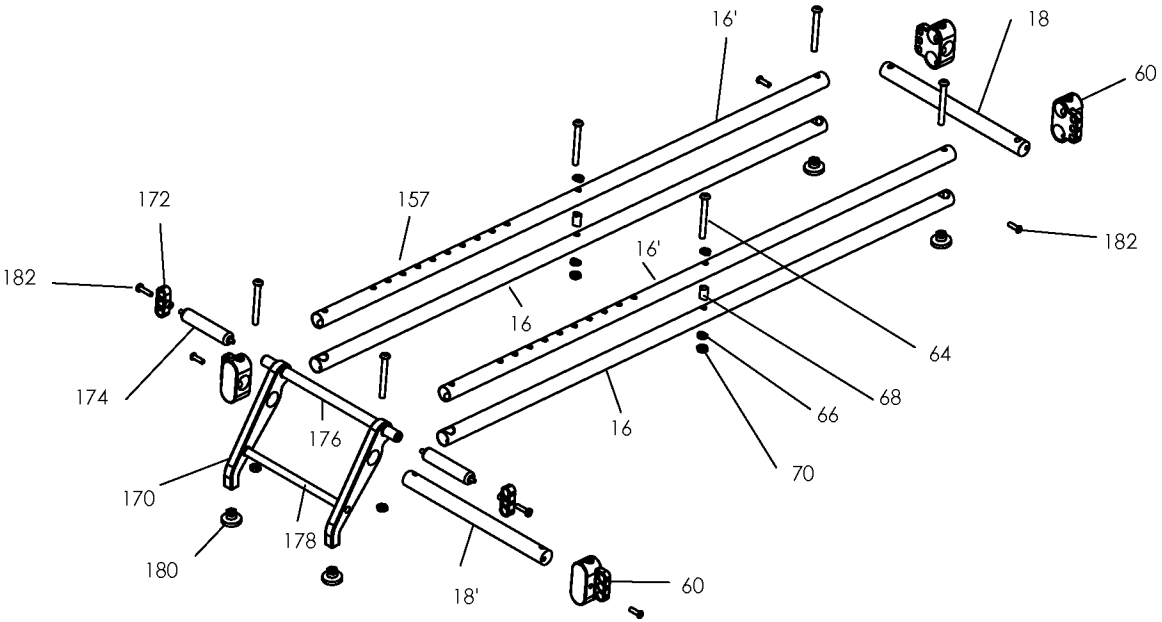
FIG. 4 is an explode perspective view of the frame assembly.
Figure 5:
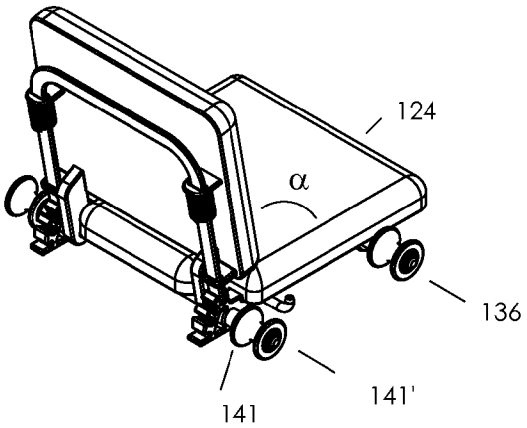
FIG. 5 is a perspective view of the seat assembly.
Figure 8:
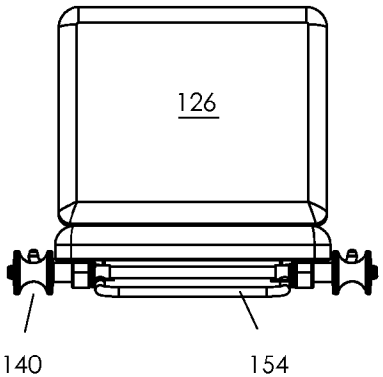
FIG. 8 is a front view of the seat assembly.
Figure 7:
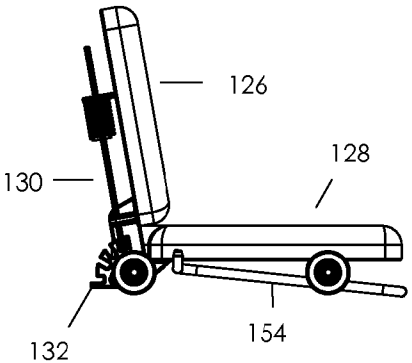
FIG. 7 is a side view of the seat assembly.
Figure 6:
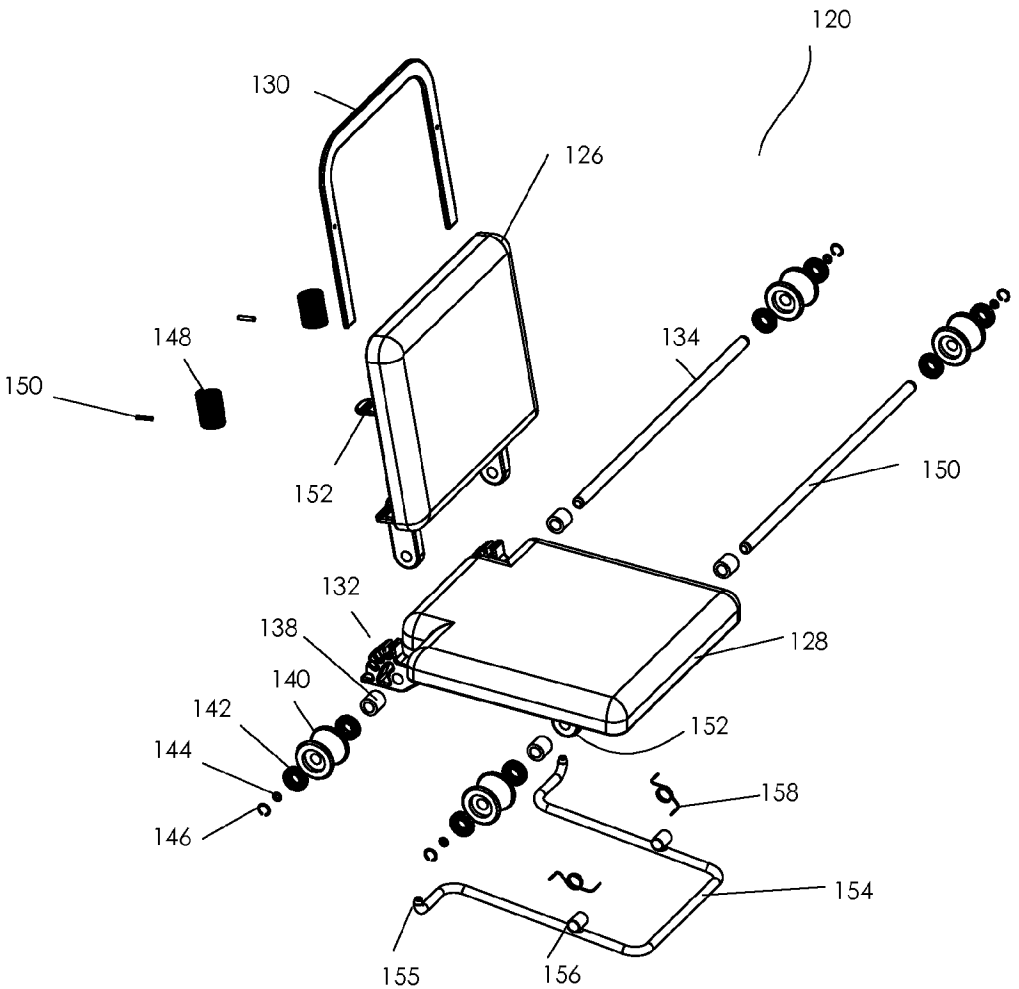
FIG. 6 is an exploded perspective view of the seat assembly.

Seat adjustment bar 154 is hingeably received by front wheel axle 150 as front wheel axle 150 pass through adjustment bar axle receiving elements 156. Seat adjustment bar 154 is tensioned through the use of seat adjustment bar spring 158. The seat adjustment bar 154 is levered to allow seat assembly 120 movement and released to prevent movement. As seat adjustment bar 154 is levered, the upturned free ends 155 are disengaged from a receiving orifice 157 located on the underside of elongated member 16' (FIG. 4). A plurality of receiving orifice 157 are available to allow for varied positioning of the seat assembly 120.

Returning to FIGS. 1 and 2, a plurality of resistance elements, for example, elastic cords are included with the exercise apparatus 10. While elastic cords are used in the exemplar, the resistance elements are not limited to elastic cords. Other known resistance elements, for example but not limited to, springs and hydraulic resistance elements are also contemplated.

Leg cord 200 is fixed at a first end 202 to a rear corner piece 61 and at a second end 204 to the pedal cord stop 102 (FIG. 9). A front hand cord 206 is fixed at a first end 208 to a front corner piece 63 and at a second end 210 to a handle 212. A rear hand cord 214 is fixed at a first end 216 to the push-up handle cord stop 172 (FIG. 4) and at a second end 218 to a handle 212. In this exemplar, there are bilaterally mounted front hand cords 206 and rear hand cords 212, as depicted in FIG. 1. Though not required, in this exemplar, the rear hand cord 212 is positioned higher than the front hand cord 206 to provide more effective leverage when sitting.

In this manner, a user can exercise multiple muscle groups. For example, after seat adjustment, muscle groups of the upper body may be exercised using the front and rear hand cords 206, 214 by repeatedly pulling on or pushing against the handle 212. Separately or simultaneously, muscle groups of the lower body and abdomen may be exercised using the leg cord 200 by repeatedly pushing against pedal 92 causing it to slidably and repeatedly move between the first pedal assembly position 20*a* and the second pedal assembly position 20*b*. Push-up handle 174 is utilized to further exercise upper body muscle groups by permitting, for example, deeper push-up exercises because the hands are in a higher position than the feet. Its raised location further allows for more effective leg and stomach exercises while in the set to run exercise position.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An exercise apparatus comprising:

a substantially rectangular frame assembly comprising a first and second set of spaced, elongated parallel members fixed below and above a front and rear cross member;

a rear leg assembly fixed to the frame assembly;

a foot pedal assembly slidably mounted to the elongated parallel members;

a seat assembly adjustably mounted between the elongated parallel members;

a plurality of frame resistance elements mounted to the frame assembly; and a pedal resistance element mounted to the frame assembly and the foot pedal assembly;

wherein the foot pedal assembly comprises:

a foot roller assembly mounted to a foot pedal carrier and rollably located against the parallel members;

upper and lower foot slider covers housing the foot pedal carrier and forming an upper and lower channel slidably receiving the parallel members; and a crank having a first arm mounted to a pedal and a second arm passing through the foot pedal carrier.

2. The exercise apparatus of claim 1 further comprising a plurality of corner pieces receiving the parallel members and front and rear cross members.

3. The exercise apparatus of claim 2 wherein the plurality of frame resistance elements comprise an elastic cord fixed at a first end to a corner piece and at a second end to a handle.

4. The exercise apparatus of claim 1 further comprising a tube spacer assembly mounted between the parallel members.

5. The exercise apparatus of claim 1 further comprising a push-up handle mounted to the rear leg assembly.

6. The exercise apparatus of claim 5 wherein the plurality of frame resistance elements comprise a push-up handle resistance element mounted to the push-up handle.

7. The exercise apparatus of claim 1 further comprising an attachment mounted to the second arm after it passes through the foot pedal carrier.

8. The exercise apparatus of claim 7 wherein the pedal resistance element comprises an elastic cord fixed at a first end to a rear corner piece and at a second end to the attachment.

9. The exercise apparatus of claim 1 wherein the seat assembly comprises:

a seat back hingably attached to a seat bottom forming a seat angle;

a spring tensioned back adjustment bar slidably fixed to the seat back and received by a ratchet mounted to the seat bottom; and a front wheel axle mounted to the seat bottom and a rear wheel axle mounted to the ratchet, each rotatively receiving a wheel assembly having a geometry such that it is rotably maintained between the parallel members.

10. The exercise apparatus of claim 9 wherein the geometry of the wheel assembly comprises a wheel having an inner and an outer flange.

11. The exercise apparatus of claim 1 wherein the plurality of frame resistance elements comprise a first resistance element mounted to a front corner piece and a second rear mounted resistance element mounted higher in relation to the first resistance element.

12. An exercise apparatus comprising:

a substantially rectangular frame assembly comprising a first and second set of spaced, elongated parallel members fixed to each other by a tube spacer assembly, further fixed below and above a front and rear cross member by a plurality of corner pieces;

a rear leg assembly fixed to the frame assembly;

a push-up handle mounted to the rear leg assembly;

a foot pedal assembly slidably mounted to the elongated parallel members;

a seat assembly adjustably mounted between the elongated parallel members;

a plurality of frame resistance elements mounted to the frame assembly; and a pedal resistance element mounted to the frame assembly and the foot pedal assembly;

wherein the foot pedal assembly comprises:

a foot roller assembly mounted to a foot pedal carrier and rollably located against the parallel members;

upper and lower foot slider covers housing the foot pedal carrier and forming an upper and lower channel slidably receiving the parallel members; and a crank having a first arm mounted to a pedal and a second arm passing through the foot pedal carrier.

13. The exercise apparatus of claim 12 further comprising an attachment mounted to the second arm after it passes through the foot pedal carrier.

14. The exercise apparatus of claim 12 wherein the seat assembly comprises:

a seat back hingably attached to a seat bottom forming a seat angle;

a spring tensioned back adjustment bar slidably fixed to the seat back and received by a ratchet mounted to the seat bottom; and a front wheel axle mounted to the seat bottom and a rear wheel axle mounted to the ratchet, each rotatively receiving a wheel assembly having a geometry such that it is rotably maintained between the parallel members, wherein the geometry of the wheel assembly comprises a wheel having an inner and an outer flange.

15. The exercise apparatus of claim 14 wherein the pedal resistance element comprises an elastic cord fixed at a first end to a rear corner piece and at a second end to the attachment, and the plurality of frame resistance elements comprise an elastic cord fixed at a first end to a corner piece and at a second end to a handle.

16. The exercise apparatus of claim 14 wherein the plurality of frame resistance elements comprise a first resistance element mounted to a front corner piece and a second resistance element mounted to the push-up handle, wherein the second resistance element is higher in relation to the first resistance element.

17. The exercise apparatus of claim 12 wherein the pedal resistance element comprises an elastic cord fixed at a first end to a rear corner piece and at a second end to the attachment, and the plurality of frame resistance elements comprise an elastic cord fixed at a first end to a corner piece and at a second end to a handle.

18. The exercise apparatus of claim 12 wherein the plurality of frame resistance elements comprise a first resistance element mounted to a front corner piece and a second resistance element mounted to the push-up handle, wherein the second resistance element is higher in relation to the first resistance element.

19. An exercise apparatus comprising:

a substantially rectangular frame assembly comprising a first and second set of spaced, elongated parallel members fixed to each other by a tube spacer assembly, further fixed below and above a front and rear cross member by a plurality of corner pieces;

a rear leg assembly fixed to the frame assembly;

a push-up handle mounted to the rear leg assembly;

a foot pedal assembly slidably mounted between the elongated parallel members;

a seat assembly adjustably mounted between the elongated parallel members;

a plurality of frame resistance elements mounted to the frame assembly; and a pedal resistance element mounted to the frame assembly and the foot pedal assembly;

wherein the foot pedal assembly comprises a foot roller assembly mounted to a foot pedal carrier and rollably located against the parallel members; upper and lower foot slider covers housing the foot pedal carrier and forming an upper and lower channel slidably receiving the parallel members; and a crank having a first arm mounted to a pedal and a second arm passing through the foot pedal carrier; and an attachment mounted to the second arm after it passes through the foot pedal carrier;

the seat assembly comprises a seat back hingably attached to a seat bottom forming a seat angle; a spring tensioned back adjustment bar slidably fixed to the seat back and received by a ratchet mounted to the seat bottom; and a front wheel axle mounted to the seat bottom and a rear wheel axle mounted to the ratchet, each rotatively receiving a wheel assembly having a geometry such that it is rotably maintained between the parallel members; wherein the geometry of the wheel assembly comprises a wheel having an inner and an outer flange;

the pedal resistance element comprises an elastic cord fixed at a first end to a rear corner piece and at a second end to the attachment; and the plurality of frame resistance elements comprise an elastic cord fixed at a first end to a corner piece and at a second end to a handle.

20. The exercise apparatus of claim 19 wherein the plurality of frame resistance elements comprise a first resistance element mounted to a front corner piece and a second resistance element mounted to the push-up handle wherein the second resistance element is higher in relation to the first resistance element.

* * * * *